US005981645A

United States Patent [19]

Hollenberg et al.

[11] Patent Number: 5,981,645

[45] Date of Patent: Nov. 9, 1999

[54] CROSSLINKABLE CREPING ADHESIVES

[75] Inventors: David Henry Hollenberg, Neenah; Phuong Van Luu, Appleton; Stephen Risley Collins, Neenah, all of Wis.

[73] Assignee: James River Corporation of Virginia, Norwalk, Conn.

[21] Appl. No.: 08/310,377

[22] Filed: Sep. 22, 1994

Related U.S. Application Data

[60] Continuation of application No. 08/080,618, Jun. 22, 1993, abandoned, which is a division of application No. 07/899,175, Jun. 15, 1992, Pat. No. 5,246,544, which is a continuation of application No. 07/591,812, Oct. 2, 1990, abandoned.

[51] Int. Cl.[6] ..... C08L 29/04

[52] U.S. Cl. ..... 524/503; 525/56; 525/61

[58] Field of Search ..... 524/4, 503; 162/112, 162/113, 282, 283; 156/183, 327; 525/56, 61

[56] References Cited

U.S. PATENT DOCUMENTS

| | | | |
|---|---|---|---|
| 3,740,366 | 6/1973 | Sanderson et al. | 525/330.6 |
| 4,043,952 | 8/1977 | Ganslaw et al. | 525/353 |
| 4,063,995 | 12/1977 | Grossman . | |
| 4,064,213 | 12/1977 | Lazorisak et al. . | |
| 4,202,925 | 5/1980 | Dabroski . | |
| 4,304,625 | 12/1981 | Grube et al. . | |
| 4,436,867 | 3/1984 | Pomplun et al. . | |
| 4,440,898 | 4/1984 | Pomplun et al. . | |
| 4,501,640 | 2/1985 | Soerens | 264/283 |
| 4,528,316 | 7/1985 | Soerens . | |
| 4,684,439 | 8/1987 | Soerens | 264/282 |
| 4,788,243 | 11/1988 | Soerens . | |
| 4,883,564 | 11/1989 | Chen et al. | 524/416 |
| 4,886,579 | 12/1989 | Clark et al. . | |

FOREIGN PATENT DOCUMENTS

| | | |
|---|---|---|
| 53-102397 | 3/1978 | Japan . |

OTHER PUBLICATIONS

Okada et al. "Preparation of Ionic Pvon Polymers" Full Translation JP, 1974.

K.J. Saunders, *Organic Polymer Chemistry* 1988, p. 130, 146–147.

Okada, "Ionic Vinyl Alcohol Copolymer"(1974) Caplus ABS# 1974:553593.

Sanderson, "Pressure Sensitive Adhesive" (1971) Caplus ABS# 1971:54550.

Stutz et al, J.of Polymer Science: Part B: Polymer Physics, vol. 28, pp. 1483–1498 (1990).

*Primary Examiner*—Cecilia J. Tsang
*Assistant Examiner*—Patrick R. Delaney
*Attorney, Agent, or Firm*—Birch, Stewart, Kolasch & Birch, LLP

[57] ABSTRACT

A creping adhesive is described which provides the ability to readily control glass transition temperature (Tg) and adhesion and which can be easily removed from dryer surfaces. The creping adhesive contains a crosslinkable polymer and preferably an ionic crosslinking agent such as metal cations having a valence of three or more.

14 Claims, 1 Drawing Sheet

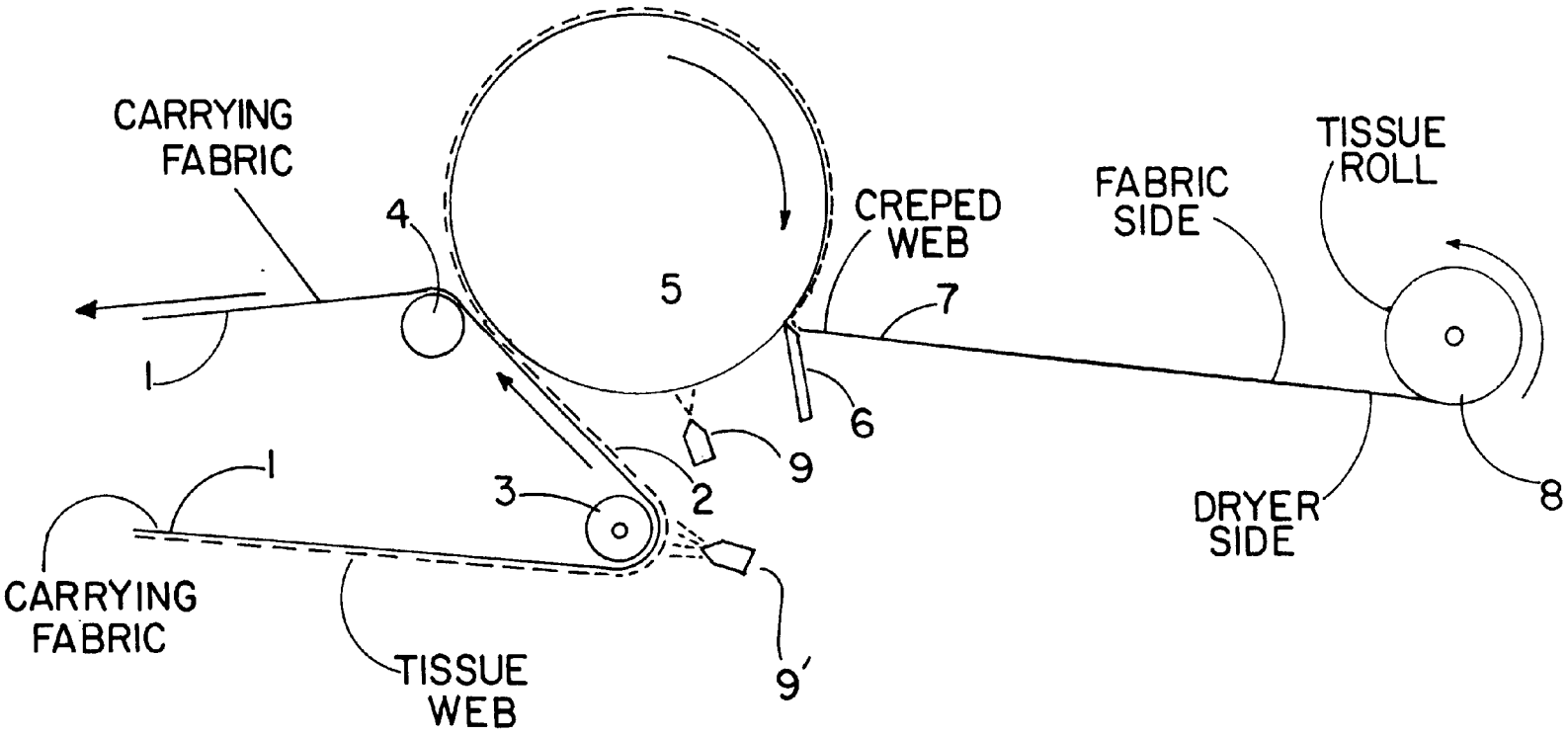
TISSUE ROLL
8
FABRIC SIDE
DRYER SIDE
CREPED WEB
7
6
9
9'
5
2
3
4
TISSUE WEB
CARRYING FABRIC
1
1
CARRYING FABRIC

CROSSLINKABLE CREPING ADHESIVES

This application is a continuation of application Ser. No. 08/080,618 filed on Jun. 22, 1993, now abandoned; which is a divisional of application Ser. No. 07/899,175 filed on Jun. 15, 1992 now U.S. Pat. No. 5,246,544; which is a continuation of application Ser. No. 07/591,812 filed on Oct. 2, 1990 now abandoned, the entire contents of which are hereby incorporated by reference.

BACKGROUND OF THE INVENTION

In the manufacture of tissue and towel products, a common step is the creping of the product. This creping is done to provide desired aesthetic and performance properties to the product. Many of the aesthetic properties of tissue and towel products rely more upon the perceptions of the consumer than on properties that can be measured quantitatively. Such things as softness, and perceived bulk are not easily quantified, but have significant impacts on consumer acceptance. Since many of the properties of tissue and towel products are controlled or are at least influenced by the creping process, it is of interest to develop methods for controlling the creping process. Although the creping process is not well understood, it is known that changes in the process can result in significant changes in the product properties. A need exists to provide a method for influencing the creping process by allowing the control of the adhesion of the tissue or towel substrate to the surface from which it is creped, most usually large cylindrical dryers known in the industry as Yankee dryers.

Obtaining and maintaining adhesion of tissue and towel products to Yankee dryers is an important factor in determining crepe quality. Inadequate adhesion results in poor or non-existing creping, whereas excessive adhesion may result in poor sheet quality and operational difficulties. Traditionally, creping adhesives alone or in combination with release agents have been applied either to the sheet or to the surface of the dryer in order to provide the appropriate adhesion to produce the desired crepe.

Various types of creping adhesives have been used to adhere fibrous webs to dryer surfaces such as Yankee dryers. Prior art creping adhesives rely upon combinations of self-crosslinkable soft polymers having a $T_g$ of less than 10° C. with a non-film forming hard polymer emulsion having a $T_g$ greater than 50° C. (U.S. Pat. No. 4,886,579) or thermoset resins (U.S. Pat. Nos. 4,528,316 and 4,501,640). The ability to control the mechanical properties of the polymers, as well as the adhesion and release of the fibrous web from the Yankee dryer, is limited when using these types of creping adhesives.

SUMMARY OF THE INVENTION

The present invention provides an improved creping adhesive which provides the ability to readily control Tg and adhesion and which can be more easily removed from dryer surfaces. Thus, the adhesive can provide high adhesion of a fibrous web to a dryer surface with low "friction", i.e., the fibrous web can be easily removed from the dryer surface. This can be accomplished while at the same time reducing or inhibiting corrosion of the dryer surface.

The essence of the present invention is that the adhesion properties of specific types of polymers can be systematically changed by varying the amount of crosslinking that may occur when the polymer is dried onto the surface of a Yankee dryer. Because crosslink density influences the mechanical properties (i.e., modulus, brittleness, Tg), this permits the adjustment of adhesion/release of the fibrous substrate onto the surface of the dryer. The nature of the polymers and types of crosslinkers used permits the incorporation of anti-corrosion components in the formulations of the present invention. This can have significant benefits in that corrosion of dryer surfaces can be a major problem in some tissue and towel mills.

The method of the present invention includes the steps of providing to the interface of a fibrous web and a support surface for the fibrous web a creping adhesive which contains a non-self-crosslinkable material and a crosslinking agent and removing the fibrous web from the support surface by creping. The process preferably includes the steps of providing to the interface of a fibrous web and a drying surface a creping adhesive which contains a polymer or oligomer having functional groups which can be crosslinked by ionic crosslinking and an ionic crosslinking agent which contains metal cations having a valence of three or more and removing the fibrous web from the drying surface with a creping blade to thereby crepe the fibrous web.

The adhesive of the present invention preferably comprises a crosslinkable polymer, oligomer or mixture thereof, metal cations having a valence of three or more to crosslink the polymer and/or oligomer and an aqueous solvent.

BRIEF DESCRIPTION OF THE DRAWING

The sole drawing FIGURE is a schematic illustration of a Yankee dryer to which a tissue web is presented, dried, creped and then wound into a soft roll.

DETAILED DESCRIPTION OF THE INVENTION

The drawing FIGURE illustrates the conventional steps in formation of a tissue paper web suitable for use as a facial tissue. This conventional process includes the steps of preforming a fibrous web, applying a creping adhesive to the surface of a Yankee dryer, applying the fibrous web to the surface of the Yankee dryer having the creping adhesive on the external surface thereof, removing the fibrous web from the Yankee dryer by use of a creping blade and winding the dried fibrous web onto a roll. Alternatively, the creping adhesive can be applied to the surface of the fibrous web that will contact the dryer, before the fibrous web is presented to the dryer.

Referring to the drawing FIGURE, this represents one of a number of possible configurations used in processing tissue products. In this particular arrangement, the transfer and impression fabric designated at 1 carries the formed, dewatered web 2 around turning roll 3 to the nip between press roll 4 and Yankee dryer 5. The fabric, web and dryer move in the directions indicated by the arrows. The entry of the web to the dryer is well around the roll from creping blade 6 which, as schematically indicated, crepes the traveling web from the dryer as indicated at 7. The creped web 7 exiting from the dryer is wound into a soft creped tissue roll 8. To adhere the nascent web 2 to the surface of the dryer, a spray 9 of adhesive is applied to the surface ahead of the nip between the press roll 4 and Yankee 5. Alternately, the spray may be applied to the traveling web 2 directly as shown at 9'. Suitable apparatus for use with the present invention are disclosed in U.S. Pat. Nos. 4,304,625 and 4,064,213, which are hereby incorporated by reference.

This illustration does not incorporate all the possible configurations used in presenting a nascent web to a Yankee dryer. It is used only to describe how the adhesive of the present invention can be used to promote adhesion and thereby influence the crepe of the product. The present invention can be used with all other known processes that rely upon creping the web from a dryer surface. In the same manner, the method of application of the adhesive to the surface of the dryer or the web is not restricted to spray applications, although these are generally the simplest method for adhesive application.

The present invention is useful for the preparation of fibrous webs which are creped to increase the thickness of the web and to provide texture to the web. The invention is particularly useful in the preparation of final products such as facial tissue, toilet tissue, paper towels and the like. The fibrous web can be formed from various types of wood pulp based fibers which are used to make the above products such as hardwood kraft fibers, softwood kraft fibers, hardwood sulfite fibers, softwood sulfite fibers, high yield fibers such as chemi-thermo-mechanical pulps (CTMP), thermomechanical pulps (TMP) or refiner mechanical pulps (RMP). Furnishes used may also contain or be totally comprised of recycled fibers (i.e., secondary fibers). The fibrous web, prior to application to the Yankee dryer, usually has a water content of 40 to 80 wt. %, more preferably 50 to 70 wt. %. At the creping stage, the fibrous web usually has a water content of less than 7 wt. %, preferably less than 5 wt. %. The final product, after creping and drying, has a base weight of 7 to 80 pounds per ream.

The creping operation itself can be conducted under conventional conditions except that the creping adhesive of the present invention is substituted for a conventional creping adhesive.

The non-self-crosslinkable material of the present invention is a polymer or oligomer which contains crosslinkable functional groups. Exemplary crosslinkable functional groups include hydroxyl, carboxyl, sulfonate, sulfate, phosphate and other functional groups containing active hydrogens and mixtures thereof.

Examples of hydroxylated polymers and oligomers that can be used in the process include polysaccharides and oligosaccharides such as starch, modified starches, partially hydrolyzed or oxidized starches, alginic acid, carageenans, water soluble derivatives of cellulose, dextrins, maltodextrins, and naturally occurring water soluble polysaccharides. Other useful hydroxylated polymers include polyvinyl alcohols, partially hydrolyzed polyvinyl acetates, and ethylenevinyl alcohols.

Examples of carboxylated polymers useful in this invention include homopolymers of acrylic and methacrylic acids, acrylic acid/methacrylic acid copolymers, partially hydrolyzed polyacrylamides and polymethylacrylamides, carboxylated polymers and copolymers obtained by polymerization or copolymerization of acrylic, methacrylic, maleic, itaconic, fumaric, crotonic, and other ethylenically unsaturated acids with suitable ethylenically unsaturated monomers. Suitable carboxylated polymers and copolymers can also be obtained through polymerization or copolymerization of unsaturated anhydrides such as maleic or itaconic anhydrides with suitable unsaturated monomers followed by hydrolysis.

Examples of sulfonate containing polymers are those derived from polymerization or suitable copolymerization of unsaturated sulfonic acids such as styrene sulfonic acid, 2-vinyl-3-bromo benzenesulfonic acid, 2-allylbenzenesulfonic acid, vinyl phenylmethane-sulfonic acid, ethylene sulfonic acid, phenylethylene sulfonic acid, 2-sulfo-vinylfurane, 2-sulfo-5-allylfurane and 1-phenylethylene sulfonic acid.

Examples of phosphate containing polymers include homopolymers or copolymers of unsaturated monomers containing a phosphoric acid moiety such as methacryloxy phosphate. Sulfated polymers useful in the invention may be derived from treatment of hydroxylated or unsaturated polymers with either sulfuric acid or sulfur trioxide/$H_2SO_4$ mixtures.

Polymers containing more than one type of functional group can also be used in this invention. Oxidized starches, carboxymethyl celluloses, potato starches, sulfated polyvinyl alcohols, gelatin, casein, protein as well as sulfated and phosphated derivatives of celluloses or starches could all find application in this invention.

Although in certain instances, some of the polymers containing more than one functional group could conceivably crosslink, e.g., internal esterification of a carboxylated cellulose, the present invention is drawn to rely upon the ability to finely control the level of crosslinking through addition of an appropriate amount of crosslinking agent. In addition to having crosslinkable functional groups, the polymer or oligomer should be water-soluble, water dispersable or capable of being formed into a water-based emulsion. The polymer or oligomer is preferably water soluble.

The non-self-crosslinkable material should be present in the creping adhesive in an amount sufficient to provide the desired results in the creping operation. If it is intended to spray the creping adhesive onto the surface of Yankee dryer, the creping adhesive should have a viscosity low enough to be easily sprayed yet high enough to provide a sufficient amount of adhesion. If the creping adhesive will be sprayed onto the surface of the Yankee dryer, it will probably have a total solids content of about 0.01 to 0.5, preferably 0.03 to 0.2% by weight based on the total weight of the adhesive. The solids content is constituted primarily by the polymer or oligomer, i.e., the crosslinkable material and the crosslinker.

Various types of crosslinking agents may be used in accordance with the present invention. Preferred crosslinking agents are ionic crosslinking agents which provide ionic crosslinking between functional groups of polymers. An added benefit of ionic crosslinking is that it is reversible at high pH. This is in contrast with many other crosslinking resins that have been used as adhesives that are thermoset resins. The reversibility of the crosslinking provides the flexibility to remove excess amounts of material that may have built up on dryer surfaces as a result of machine operational problems. For example, if it is desired to remove built up adhesives, the adhesive can be treated with a basic solution, which preferably is an aqueous basic solution having a non-volatile base dissolved therein. As the water evaporates, the pH of the solution will rise causing the crosslinks to hydrolyze thereby allowing easier removal of the built up layer(s) of polymer from the machine.

Metal cations with a valency of 3 or more, and more preferably 4 or more may be used as crosslinking agents. Exemplary cations are $Fe^{+3}$, $Cr^{+4}$, $Cr^{+6}$, $Ti^{+4}$, $Zr^{+4}$, etc. Zirconium has been found to be a particularly useful crosslinking agent because it is capable of crosslinking hydroxylated polymers as well as the more acidic carboxylated and sulfonated polymers.

Although zirconium compound cations are the preferred crosslinkers, it has been found that mixtures of zirconium and aluminum ions are effective in providing crosslinking of complex polymers containing more than one type of functional group. For example, aluminum will crosslink carboxyl and sulfonate groups. Mixtures of polymers, for example, polyvinyl alcohol and polyacrylamides (partially hydrolyzed) can be effectively crosslinked using mixtures of aluminum and zirconium ions.

The crosslinker will usually be added to the creping adhesive in the form of a water-soluble salt or water-soluble "complex" which provides cations upon dissolution in water. An example of one type of complex is ammonium zirconium carbonate.

The crosslinker should be present in the creping adhesive in an amount sufficient to provide changes in the mechanical properties of the polymer once the solution has been evaporated and the polymer crosslinked. As the level of crosslinking increases, the mechanical properties change with the crosslink density. Increased crosslinking generally will increase the $T_g$, increase the brittleness and provide different responses to mechanical stresses than uncrosslinked polymers. Obtaining the appropriate crosslink density will depend not only on the relative concentration of added crosslinker but also on the type of polymer employed, the functional groups present, and the molecular weight of the polymer. Early work demonstrated that, in general, as the molecular weight of the starting polymer increases, the amount of crosslinker necessary to provide particular levels of final properties (i.e., $T_g$, brittleness, etc.) decreases. A discussion concerning the relationship between $T_g$ and crosslinking of polymers is contained in the article by Stutz et al, Journal of Polymer Science, 28, 1483–1498 (1990), the entire contents of which is hereby incorporated by reference.

For most of the polymers used in the present invention, the amount of crosslinker, i.e., the compound which provides the cations, necessary to promote improvements in adhesion is in the range of 0.5 to 10% by weight based on the weight of the polymer to be crosslinked. The ability to control the mechanical properties of crosslinked polymers by varying the amount of crosslinker is the essential part of the invention. It is believed that a key property influenced by crosslink density is the $T_g$. Since prior work has claimed that $T_g$ does influence adhesive properties (see U.S. Pat. Nos. 4,064,213; 4,886,579; 4,063,995; 4,304,625), the ability to change or modify $T_g$ through crosslink density offers an opportunity to control the adhesion and subsequent creping. The exact amount of crosslinker will depend upon the desired properties of the adhesive, the type of non-self-crosslinking material, and the molecular weight of the non-self-crosslinking material.

While the polymer and crosslinker are the major "active" ingredients of the present invention, other materials can be incorporated with beneficial results. Materials can be added to modify the mechanical properties of the crosslinked polymers. Some of these materials may actually be incorporated into the crosslinked polymer. Examples would include glycols (ethylene glycol, propylene glycol, etc.), polyethylene glycols, and other polyols (simple sugars and oligosaccharides). Other components can be added to modify interfacial phenomena such as surface tension or wetting of the adhesive solution. Nonionic surfactants such as the octyl phenoxy based Triton (Rohm & Haas, Inc.) surfactants or the Pluronic or Tetronic (BASF Corp.) surfactants can be incorporated in the present invention to improve surface spreading or wetting capabilities. Mineral oils or other low molecular weight hydrocarbon oils or waxes can be included to modify interfacial phenomena.

Finally, one additional class of materials can be added to the formulation. These are phosphate salts or salts of phosphate oligomers. Addition of these materials will provide some buffering capability as well as provide changes in the surface tension of the solution. The major purpose for inclusion is, however, the anti-corrosive properties of phosphates. While some of the other materials used in the formulations of the present invention provide anti-corrosive properties (most notably the zirconium containing crosslinkers), it is expected that the addition of phosphates to the formulation will enhance the overall anti-corrosive properties of the adhesive formulation. If phosphate is incorporated, it should be added in an amount of 5 to 15 wt. %, preferably 5 to 10 wt. % based on the total weight of the adhesive formulation.

The various components of the adhesive formulation, i.e., non-self-crosslinking polymer, crosslinking agent, polymer modifiers, surfactants, and anti-corrosive additives, will all be dissolved, dispersed, suspended, or emulsified in a liquid carrying fluid. This liquid will usually be a non-toxic solvent such as water.

The liquid component is usually present in an amount of 90 to 99.98 wt. %, preferably 99 to 99.9 wt. % based on the total weight of the creping adhesive. The pH of the adhesive when it is applied to the desired surface in the papermaking operation will usually be about 7.5 to 11. The solvent preferably consists essentially (or completely) of water. If other types of solvents are added, they are preferably added in small amounts.

EXAMPLES

In the following Examples, the adhesive is prepared by dissolving the indicated ingredients in water in the amounts indicated. The creping adhesive is applied to a small hand sheet which is then applied to a hot oil-heated cylinder which can be rotated at a controlled speed. This small lab-sized piece of equipment is used to simulate a Yankee dryer. The drum is rotated until the sheet is virtually dry, and a creping blade is placed on the surface of the drum to crepe the sheet from the drum. During this creping, the torque necessary to bring about creping is measured. This measurement allows the calculation of a torque-adhesion relationship and provides indications of the lubrication and release characteristics of the coating adhesive. Torque, adhesion and polymer buildup/release observations and calculations are shown in Table 1. The properties of some of these products are shown in Table 2.

TABLE 1

| | | $t_1$ | | T | | $t_2$ | | (T—$t_2$) | | ($t_2$—$t_1$) | |
|---|---|---|---|---|---|---|---|---|---|---|---|
| Sample # | Combinations | AVG (Nm) | STD (Nm) | AVG (Nm) | STD (Nm) | AVG (Nm) | STD (Nm) | AVG (Nm) | STD (Nm) | AVG (Nm) | STD (Nm) |
| 1 | 3g $ZrO_2$ | 3.24 | 0.29 | 5.84 | 0.44 | 5.32 | 0.38 | 0.52 | 0.32 | 2.08 | 0.19 |
| 2 | 3g PVA | 3.07 | 0.10 | 4.88 | 0.08 | 2.78 | 0.06 | 2.10 | 0.11 | −0.29 | 0.12 |
| 3 | 3g PVA+1.5g $ZrO_2$ | 3.43 | 0.25 | 6.24 | 0.20 | 3.58 | 0.19 | 2.66 | 0.18 | 0.15 | 0.17 |
| 4 | 3g PVA+1.5g $Na_3PO_4$ | 3.56 | 0.07 | 4.45 | 0.21 | 2.38 | 0.09 | 2.07 | 0.17 | −1.18 | 0.12 |

TABLE 1-continued

| Sample # | Combinations | $t_1$ AVG (Nm) | $t_1$ STD (Nm) | T AVG (Nm) | T STD (Nm) | $t_2$ AVG (Nm) | $t_2$ STD (Nm) | (T—$t_2$) AVG (Nm) | (T—$t_2$) STD (Nm) | ($t_2$—$t_1$) AVG (Nm) | ($t_2$—$t_1$) STD (Nm) |
|---|---|---|---|---|---|---|---|---|---|---|---|
| 5 | .75g $ZrO_2$+1.5g $Na_3PO_4$+3g PVA | 3.06 | 0.04 | 5.86 | 0.13 | 3.09 | 0.08 | 2.77 | 0.12 | 0.02 | 0.07 |
| 6 | 3g PVA+.75g $ZrO_2$ | 3.13 | 0.10 | 5.73 | 0.25 | 3.23 | 0.11 | 2.50 | 0.25 | 0.01 | 0.06 |

t1 - torque on cylinder before application of adhesive and sample
T - torque on cylinder during creping of sample (with adhesive) from cylinder
t2 - torque on cylinder after removal of sample
T—t2 - sample adhesion
t2—t1 - Polymer buildup/release
$ZrO_2$ - Ammonium zirconium carbonate or BaCote 20, Magnesium Electron Corp.
PVA - Polyvinyl Alcohol - Airvol 540, Air Products Corp.
$Na_3PO_4$ - trisodium phosphate - reagent grade.

TABLE 2

| | Unit | Sample 1 | Sample 2 | Sample 3 | Sample 4 | Sample 5 |
|---|---|---|---|---|---|---|
| Wave Length | (uM) | 176.75 | 175.540 | 173.260 | 165.670 | 179.850 |
| Crepe/cm | (#) | 56.045 | 56.678 | 58.745 | 59.445 | 55.468 |
| % Void-Area | (%) | 3.181 | 3.265 | 3.401 | 2.037 | 4.651 |
| Basis Weight | (lbs./R) | 11.009 | 11.156 | 11.203 | 11.163 | 11.003 |
| Caliper | (0.001) | 4.167 | 4.050 | 4.144 | 4.056 | 4.161 |
| Bulk | ($cm^3$/g) | 5.907 | 5.666 | 5.773 | 5.671 | 5.902 |
| Water ABS Rate | (Sec) | 2.052 | 2.833 | 2.5 | 3.218 | 2.548 |
| MD-Tensil | (G) | 1483 | 1573 | 1446 | 1688 | 1549 |
| CD-Tensil | (G) | 796 | 885 | 788 | 888 | 809 |
| Breaking Length | (Km) | 0.795 | 0.852 | 0.768 | 0.884 | 0.820 |
| MD- % Disp. | (%) | 15.79 | 16.858 | 16.416 | 16.83 | 17.16 |
| CD- % Disp. | (%) | 2.943 | 2.871 | 2.924 | 2.702 | 2.863 |

We claim:

1. A two part creping adhesive composition capable of reversible ionic crosslinking, comprising:

a) a first part comprising a water dispersible ionically crosslinkable material comprising polyvinyl alcohol homopolymers;

b) a second part comprising 0.5 to 10% by weight, based on the amount of the polymer to be crosslinked, of one or more metal, cationic crosslinking agents having a valence of three or more, said metal, cationic crosslinking agents being capable of crosslinking said ionically crosslinkable material by forming hydrolyzable ionic crosslinks; and c) optionally, modifiers selected from the group consisting of glycols, polyethylene glycols, polyols, surfactants, oils, waxes, phosphate salts and salts of phosphate oligomers;

wherein the amount of said metal, cationic crosslinking agent is sufficient to crosslink said ionically crosslinkable material and wherein the pH of said adhesive is about 7.5 to 11.

2. A two part creping adhesive composition capable of reversible ionic crosslinking, consisting essentially of:

a) a first part consisting essentially of water dispersible ionically crosslinkable materials which are polymers or oligomers consisting essentially of polyvinyl alcohol homopolymers;

b) a second part consisting essentially of 0.5 to 10% by weight, based on the amount of the polymer to be crosslinked, of one or more metal, cationic crosslinking agents having a valence of three or more, said metal, cationic crosslinking agents being capable of crosslinking said ionically crosslinkable polymer or oligomer by forming hydrolyzable ionic crosslinks; and, c) optionally, modifiers selected from the group consisting of glycols, polyethylene glycols, polyols, surfactants, oils, waxes, phosphate salts and salts of phosphate oligomers;

wherein the amount of said metal, cationic crosslinking agent is sufficient to crosslink said ionically crosslinkable material to form an adhesive suitable for use in creping of tissue from a Yankee dryer and wherein the pH of said adhesive is about 7.5 to 11.

3. The adhesive composition of claim 1, wherein said ionically crosslinkable material and said crosslinking agents are present in a combined amount of about 0.01 to 0.5% by weight, based on the total weight of said adhesive.

4. The adhesive composition of claim 1, wherein said adhesive further comprises a water soluble polymer selected from the group consisting of starch, partially hydrolyzed starch, oxidized starch, alginic acid, carageenan, water soluble cellulose, dextrin, maltodextrin, water soluble polysaccharide, partially hydrolyzed polyvinyl acetate and ethylenevinyl alcohol.

5. The adhesive composition of claim 1, wherein said metal, cationic crosslinking agent is a water-soluble salt or complex containing cations selected from the group consisting of $Fe^{3+}$, $Cr^{4+}$, $Cr^{6+}$, $Ti^{4+}$ and $Zr^{4+}$.

6. The adhesive composition of claim 1, wherein said metal, cationic crosslinking agent comprises a mixture of water-soluble salts or complexes containing $Zr^{4+}$ and $Al^{3+}$ cations.

7. The adhesive composition of claim 2, wherein said water dispersible, ionically crosslinkable materials further comprise an additional water soluble polymer selected from the group consisting of starch, partially hydrolyzed starch, oxidized starch, alginic acid, carageenan, water soluble cellulose, dextrin, maltodextrin, water soluble polysaccharide, partially hydrolyzed polyvinyl acetate and ethylenevinyl alcohol.

8. The adhesive composition of claim 2, wherein said metal, cationic crosslinking agent is a water-soluble salt or complex containing cations selected from the group consisting of $Fe^{3+}$, $Cr^{4+}$, $Cr^{6+}$, $Ti^{4+}$ and $Zr^{4+}$.

9. The adhesive composition of claim 2, wherein said metal, cationic crosslinking agent comprises a mixture of water-soluble salts or complexes containing $Zr^{4+}$ and $Al^{3+}$ cations.

10. The adhesive composition of claim 7, wherein said metal, cationic crosslinking agent comprises a mixture of water-soluble salts or complexes containing $Zr^{4+}$ and $Al^{3+}$ cations.

11. The adhesive composition of claim 1, wherein said crosslinking agent comprises $Zr^{4+}$ cations.

12. The adhesive composition of claim 11, wherein said crosslinking agent further comprises $Al^{3+}$ cations.

13. The adhesive composition according to claim 1, wherein said crosslinking agent is ammonium zirconium carbonate.

14. The adhesive composition according to claim 2, wherein said crosslinking agent is ammonium zirconium carbonate.

* * * * *